US010310412B2

(12) United States Patent
Fukatsu et al.

(10) Patent No.: US 10,310,412 B2
(45) Date of Patent: Jun. 4, 2019

(54) DEVELOPING APPARATUS, CARTRIDGE, AND IMAGE FORMING APPARATUS FOR SUPPRESSING DEVELOPER LEAKAGE OF A FRAME

(71) Applicant: CANON KABUSHIKI KAISHA, Tokyo (JP)

(72) Inventors: Makoto Fukatsu, Suntou-gun (JP); Yuta Isobe, Kawasaki (JP); Shunsuke Mizukoshi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/935,730

(22) Filed: Mar. 26, 2018

(65) Prior Publication Data

US 2018/0284648 A1 Oct. 4, 2018

(30) Foreign Application Priority Data

Mar. 30, 2017 (JP) ..... 2017-069286
Feb. 27, 2018 (JP) ..... 2018-033618

(51) Int. Cl.
*G03G 15/08* (2006.01)
*G03G 21/18* (2006.01)
*G03G 15/09* (2006.01)

(52) U.S. Cl.
CPC ..... *G03G 15/0881* (2013.01); *G03G 15/0812* (2013.01); *G03G 15/09* (2013.01); *G03G 21/1814* (2013.01); *G03G 15/0875* (2013.01)

(58) Field of Classification Search
CPC ..... G03G 15/0881
USPC ..... 399/111
See application file for complete search history.

(56) References Cited

U.S. PATENT DOCUMENTS

2013/0071148 A1 3/2013 Ishikura

FOREIGN PATENT DOCUMENTS

JP 61-185772 A 8/1986

OTHER PUBLICATIONS

Computer translation of JP61-185772A to Murai et al., Aug. 1986.*

* cited by examiner

*Primary Examiner* — Quana Grainger
(74) *Attorney, Agent, or Firm* — Canon U.S.A., Inc. IP Division

(57) ABSTRACT

A developing apparatus, a cartridge, and an image forming apparatus in which, in a longitudinal direction, an edge portion of a carrying portion is disposed so as to be positioned outside an inner edge portion of an edge portion sealing member, and inside an outer edge portion of the edge portion sealing member. An edge portion of the restricting member is disposed so as to be positioned outside the edge portion of the carrying portion, and inside the outer edge portion of the edge portion sealing member.

45 Claims, 7 Drawing Sheets

DEVELOPING APPARATUS, CARTRIDGE, AND IMAGE FORMING APPARATUS FOR SUPPRESSING DEVELOPER LEAKAGE OF A FRAME

BACKGROUND OF THE INVENTION

Field of the Invention

The present disclosure relates to a developing apparatus and a cartridge that are used in an image forming apparatus, such as an electrophotographic printer or an electrophotographic copying machine, that forms an image on a recording material, and to an image forming apparatus.

Description of the Related Art

Typically, a developing apparatus (or a cartridge, or an image forming apparatus) includes a developing roller, a developing blade, and a frame (a developer case) that rotatably supports the developing roller at edge portions thereof in a longitudinal direction. Furthermore, an edge portion seal that prevents developer from leaking from an edge portion of the frame (the developer case) is provided between the edge portions of the developing roller and the edge portion of the frame.

Specifically, while the edge portion seal is disposed between the edge portions of the developing roller and the edge portion of the frame that oppose each other, portions of edge portions of the developing blade are further disposed so as to enter between the edge portion seal and the developing roller. In other words, while a surface of the edge portion seal on a first side abuts against the frame, a surface on a second side includes areas that abut against the edge portions of the developing roller, and areas that abut against the edge portions of the developing blade. For example, in a developing apparatus described in a patent literature, Japanese Patent Laid-Open No. 61-185772, a configuration is disclosed in which a portion of an edge portion of a developing blade is disposed between an edge portion seal and a developing roller.

However, in the configuration of the developing apparatus in Japanese Patent Laid-Open No. 61-185772, in a case in which a carrying layer that is capable of carrying the developer to the edge portion is not formed in the longitudinal direction of the developing roller, there are cases in which, compared with the center portion, the charge amount of the developer at the edge portion is different or the charge amount is insufficient. In such a case, the charge amount of the developer at the edge portion is not optimized and there is a concern of a deficiency called an "edge portion fogging" occurring in the image edge portion.

SUMMARY OF THE INVENTION

The present disclosure has been made in view of the abovementioned and provides a developing apparatus, a cartridge, and an image forming apparatus that, while effectively suppressing leakage of the developer from the edge portion of the frame that stores the developer, are capable of reducing occurrence of deficiency in the image edge portion.

A developing apparatus according to a first aspect of the present disclosure includes a developer carrying member that includes a carrying portion that carries developer, a developing frame that stores the developer carried by the developer carrying member, the developing frame rotatably supporting the developer carrying member at an edge portion of the developer carrying member in a longitudinal direction, a restricting member disposed in the longitudinal direction, the restricting member restricting a thickness of the developer carried on the carrying portion, and an edge portion sealing member disposed between the edge portion of the developer carrying member and an edge portion of the developing frame that supports the edge portion of the developer carrying member, the edge portion sealing member restricting leakage of the developer in the edge portion of the developing frame. In the developing apparatus, in the longitudinal direction, an edge portion of the carrying portion is disposed so as to be positioned outside an inner edge portion of the edge portion sealing member, and inside an outer edge portion of the edge portion sealing member, and an edge portion of the restricting member is disposed so as to be positioned outside the edge portion of the carrying portion, and inside the outer edge portion of the edge portion sealing member.

Furthermore, a cartridge according to a second aspect of the present disclosure includes an image carrying member on which an electrostatic latent image is formed, and the developing apparatus according to the first aspect of the present disclosure in which the cartridge develops the electrostatic latent image formed on the image carrying member.

Furthermore, an image forming apparatus according to a third aspect of the present disclosure includes an image carrying member on which an electrostatic latent image is formed, and the developing apparatus according to the first aspect of the present disclosure in which the cartridge develops the electrostatic latent image formed on the image carrying member.

Further features of the present disclosure will become apparent from the following description of exemplary embodiments with reference to the attached drawings.

DESCRIPTION OF THE EMBODIMENTS

The present disclosure can also be implemented in the form of a developing apparatus, a cartridge, or an image forming apparatus.

Hereinafter, image forming apparatuses according to exemplary embodiments of the present disclosure will be described with reference to the drawings. Note that the exemplary embodiments described hereinafter illustrate the present disclosure in an exemplified manner, and the dimensions, the materials, the shapes, and the relative positions described hereinafter do not limit the scope of the present disclosure unless particularly described in a specific manner.

First Exemplary Embodiment

In an image forming apparatus (also referred to as an electrophotographic image forming apparatus) of a first exemplary embodiment of the present disclosure, an image is recorded (formed) on a recording medium mainly through an electrophotographic process described below.

In other words, the image forming apparatus uniformly charges an electrophotographic photosensitive member (hereinafter, referred to as a "photosensitive member") serving as an image carrying member capable of forming an electrostatic latent image thereon. Subsequently, an electrostatic latent image is formed on the photosensitive member by selectively exposing the charged photosensitive member. Subsequently, the electrostatic latent image formed on the photosensitive member is visualized as a toner image with toner serving as the developer. Furthermore, the toner image formed on the photosensitive member is transferred onto a recording material, such as a recording sheet or a plastic sheet. Moreover, the toner image is fixed to the recording material by applying heat and pressure to the toner image that has been transferred on the recording material.

Furthermore, in the image forming apparatus of the present exemplary embodiment, a photosensitive drum, a charging member, a developing member, a cleaning member, and other members can be integrated inside a frame so as to form a cartridge. Note that the cartridge (for example, a process cartridge) formed into a cartridge is detachable from an apparatus main body of the image forming apparatus.

Furthermore, the cartridge may include, for example, at least either one of a cleaning unit including a photosensitive drum, a developing unit (a developing apparatus) including a developing member, and a toner unit that supplies developer. For example, the developing member may be configured as a cartridge (a developing cartridge) that is detachable from the apparatus main body of the image forming apparatus.

Overall Configuration of Electrophotographic Image Forming Apparatus

Figure 2:
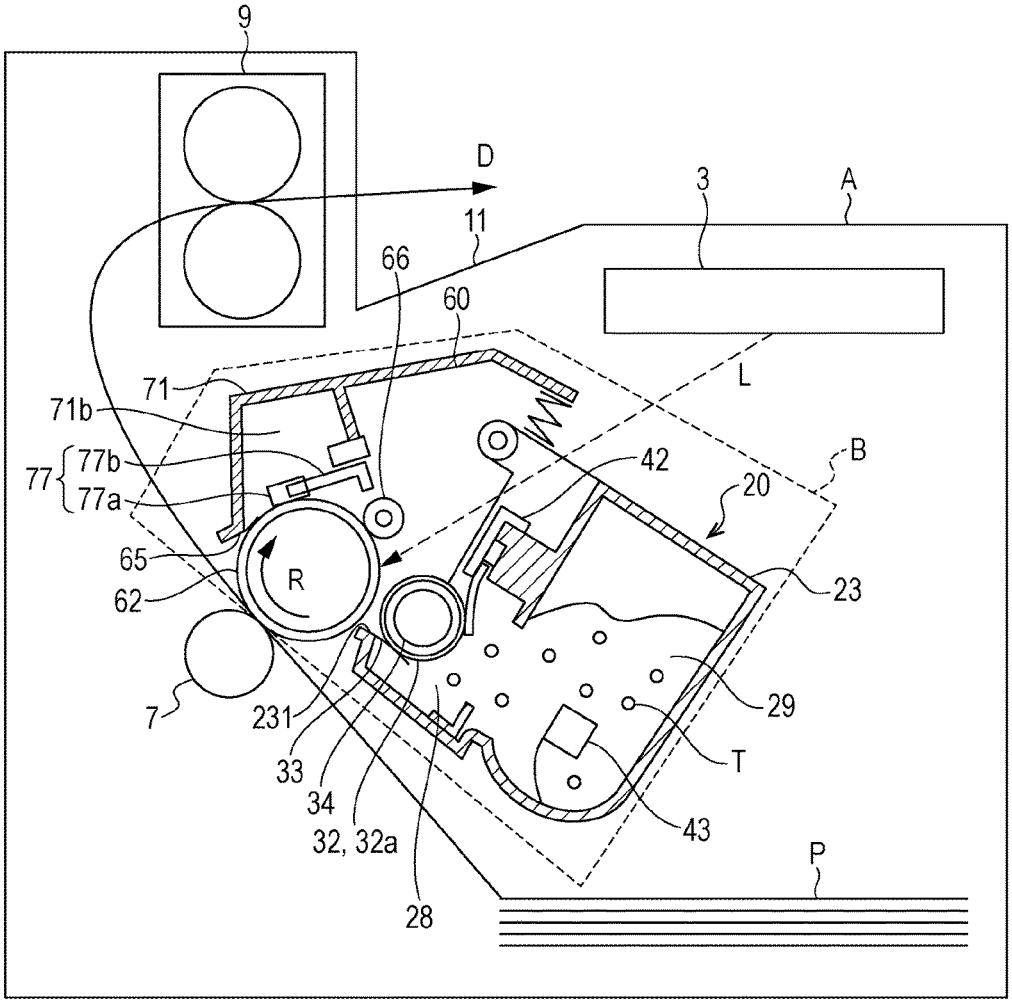
FIG. 2 is a schematic cross-sectional view of the image forming apparatus according to the first exemplary embodiment of the present disclosure.

Referring first to FIG. 2, an overall configuration of the electrophotographic image forming apparatus (the image forming apparatus) according to an embodiment of the present disclosure will be described. FIG. 2 is a cross-sectional schematic view of the image forming apparatus of the present exemplary embodiment.

As illustrated in FIG. 2, the image forming apparatus of the present exemplary embodiment mainly includes an apparatus main body A, and a process cartridge B (hereinafter, may be referred merely as a cartridge B) detachable from the apparatus main body A. Note that the apparatus main body A of the present exemplary embodiment includes all of the components in FIG. 2 except for the components inside the broken line (the components of the cartridge B).

Specifically, an exposing device 3 (a laser scanner unit) that forms an electro latent image on an electrophotographic photosensitive drum 62 (hereinafter, referred to as a drum 62) of the cartridge B is disposed in the apparatus main body A. Furthermore, a sheet tray (not shown) that stores recording materials (hereinafter, referred to as sheet members P) such as a recording medium is disposed in the apparatus main body A at a portion below the cartridge B.

Furthermore, a transfer roller 7, a fixing device 9, a discharge tray 11, and the like are, along a conveyance direction D of the sheet member P, sequentially disposed in the apparatus main body A on a conveyance path.

Image Forming Process

An image forming process of the present exemplary embodiment will be described next.

In the present exemplary embodiment, the image forming process is started by an image formation start signal. In other words, the drum 62 is rotationally driven at a predetermined circumferential velocity (a processing speed) in a rotation direction R on the basis of the image formation start signal. Furthermore, a charge roller 66, to which a bias voltage is applied, evenly and uniformly charges an outer peripheral surface of the drum 62 by coming in contact with the outer peripheral surface of the drum 62.

Subsequently, the exposing device 3 outputs a laser beam L according to image information. In other words, the laser beam L passing through a laser opening provided in a cleaning frame 71 of the cartridge B performs scanning exposure on the outer peripheral surface of the drum 62. With the above, an electrostatic latent image according to the image information is formed on the outer peripheral surface of the drum 62.

Meanwhile, in a developing unit 20 serving as a developing apparatus, toner T inside a toner chamber 29 serving as a developer storing chamber is mixed and conveyed by rotation of a conveying member 43 and is sent out to a toner supply chamber 28 serving as a developing chamber.

Note that the toner T is attracted and carried on a surface of a developing roller 32 (a developer carrying member) with magnetic force of a magnet roller 34 (a stationary magnet). Furthermore, while the toner T is triboelectrically charged, the thickness of the toner T on the peripheral surface of the developing roller 32 is restricted with a developing blade 42. Note that the toner T is adhered to the surface of the drum 62 according to the electrostatic latent image and is made into a visible image (developed) as a toner image.

Matched with an output timing of the laser beam L, the sheet member P stored in the lower portion of the apparatus main body A is sent out from the sheet tray. Note that the sheet member P is conveyed to a transfer position where the drum 62 and the transfer roller 7 oppose each other.

The toner image is transferred from the drum 62 to the sheet member P at the transfer position. The sheet member P on which the toner image has been transferred is separated from the drum 62 and is conveyed to the fixing device 9. Subsequently, by passing the sheet member P through a nip portion between a heating roller and a pressing roller constituting the fixing device 9, compression and heating is performed on the sheet member P at the nip portion to fix the toner image to the sheet member P. Lastly, the sheet member P that has undergone a toner image fixing process is discharged on the discharge tray.

Note that the drum 62 that has performed transferring is used in the next image forming process after the residual toner on the outer peripheral surface thereof is removed with a cleaning member (a blade) 77. Meanwhile, the toner that has been removed from the photosensitive drum 62 is stored in a waste toner chamber 71*b* of a cleaning unit 60. Note that in the present exemplary embodiment, a scooping sheet 65 that prevents the toner from leaking from the waste toner chamber 71*b* is provided in the frame of the cleaning unit 60.

As described above, process members, such as the charge roller 66, the developing roller 32, the transfer roller 7, and the cleaning member 77 that at least act on the drum 62, are provided in the process cartridge B of the present exemplary embodiment.

Configuration of Process Cartridge

Hereinafter, a configuration of the cartridge B of the present exemplary embodiment will be described with reference to FIG. 2.

In the present exemplary embodiment, the cartridge B mainly includes the cleaning unit 60 and the developing unit 20. Note that the cartridge B includes the electrophotographic photosensitive member (the drum 62) and the members, such as the charging member (the charge roller 66), the developing member (the developing unit 20), and the cleaning member (the cleaning member 77), serving as process members that act on the electrophotographic photosensitive member that are formed into a cartridge in an integrated manner. Furthermore, the cartridge B is detachable from the apparatus main body of the image forming apparatus.

Note that not limited to the above, the process cartridge B may be a member that is formed into a cartridge with at least one of the charging member, the developing member, and the cleaning member described above, for example.

Cleaning Unit

In the present exemplary embodiment, the process cartridge B includes the cleaning unit 60.

As illustrated in FIG. 2, the cleaning unit 60 includes the drum 62, the charge roller 66, the cleaning member 77, the cleaning frame 71 that supports the above members. Furthermore, in the cleaning unit 60, the charge roller 66 and the cleaning member 77 are disposed so as to be in contact with the outer peripheral surface of the drum 62. Note that the cleaning member 77 includes a rubber blade 77*a* formed of a blade-shaped elastic member, and a supporting member 77*b* that supports the rubber blade 77*a*.

The rubber blade 77*a* is disposed in a direction countering the rotation direction of the drum 62 and abut against the surface of the drum 62. In other words, a leading edge portion of the rubber blade 77*a*, which is a free end of the rubber blade 77*a* opposite to the side supported by the supporting member 77*b*, is abutted against the drum 62 while being oriented towards the upstream side in the rotation direction of the drum 62. Meanwhile, the drum 62 is rotationally driven in the rotation direction R illustrated in FIG. 2 in accordance with an image forming operation by receiving driving force from a main body drive motor (not shown) serving as a drive source.

The charge roller 66 is rotatably attached to the cleaning unit 60. Furthermore, the charge roller 66 is in pressure contact with the drum 62 by having pressure applied thereto towards the drum 62 and is rotated so as to follow the rotation of the drum 62.

Developing Unit

As illustrated in FIG. 2, in the present exemplary embodiment, the developing unit 20 mainly includes the developing roller 32, a developer case 23 that supports the developing roller 32 and that stores toner (developer) T therein, and the developing blade 42 that restricts the developer on the developer carrying member.

Note that the developing roller 32 of the present exemplary embodiment constitutes the "developer carrying member" of the present disclosure, the developer case 23 constitutes a "developing frame", and the developing blade 42 constitutes a "restricting member".

Specifically, the developing roller 32 includes a cylindrical-shaped base 32*a* (see FIG. 1), and a developer carrying layer 32*b* (a carrying portion, see FIG. 1) provided on an outer surface of the base 32*a*. Furthermore, the magnet roller 34 is inserted and provided inside the base 32*a*. Furthermore, in the developing unit 20, the developing blade 42 that restricts the layer thickness of the toner carried on the front surface (the carrying layer 32*b*) of the developing roller 32 is disposed in the longitudinal direction of the developing roller. Note that the developing roller 32 is fitted in an opening 231 of the developer case 23.

Furthermore, gap maintaining members (not shown) are attached to two edge portions 32*a*1 (see FIG. 1) of the developing roller 32 in the longitudinal direction of the developing roller 32 (the base 32*a*). By abutting the gap maintaining members against the drum 62, the developing roller 32 is held so as to form a predetermined minute gap with the drum 62.

The developing roller 32 is rotatably supported by the developer case 23 (the developing frame) at the two edge portions 32*a*1 in the longitudinal direction. Furthermore, as described later, sealing members 45 (edge portion sealing members corresponding to each of the two edge portions 32*a*1) are disposed so as to be interposed between the edge portions 32*a*1 of the developing roller 32 (the base 32*a*) and edge portions (not shown) of the developer case 23. Leakage of the developer at the edge portions of the developer case 23 (the developing frame) is restricted with the sealing members 45.

Furthermore, as illustrated in FIG. 2, a bleeding out prevention sheet 33 that prevents the toner from bleeding out from the opening 231 of the developing unit 20 is provided. Note that the bleeding out prevention sheet 33 is provided so as to abut against the developing roller 32.

Furthermore, the conveying member 43 is provided in the toner chamber 29 of the developer case 23. The toner stored in the toner chamber 29 is mixed and is conveyed to the toner supply chamber 28 (the developing chamber) by the conveying member 43.

In the present exemplary embodiment, the developing roller 32 is reliably pressed against the drum 62 by biasing the developing unit 20 with urging force of an urging member (not shown), such as a spring, so that the developing unit 20 approaches the cleaning unit 60. Furthermore, the developing roller 32 is held so as to form a predetermined space with the drum with the gap maintaining members attached to the two edge portions of the developing roller 32.

Note that in a known and typical configuration, in order to obtain seal characteristics of the edge portion of the frame, the contact pressure of an edge portion seal against the developing roller needs to be increased (pressing the developing roller towards the edge portion seal is required). In such a case, due to the pressing, the developing blade may be deformed (stretched) along the peripheral surface of the developing roller in areas where the edge portion seal and the edge portions of the developing blade abut against each other.

Accordingly, in the known and typical configuration, in an axial direction of the developing roller, portions of the developing blade that are near the edge portions and that are inside the edge portion seal become easily lifted away from the surface of the developing roller. As the developer enters the gap increased by such lifting away of the developing blade, a problem such as the developer easily leaking out to the outside at the edge portion of the frame may occur.

To address such a problem in the known and typical configuration, Japanese Patent Laid-Open No. 61-185772 proposes a configuration in which cutouts are provided in the edge portions of the developing blade against which the edge portion seal abuts. According to such a configuration, the lifting up of the edge portions of the developing blade due to the deformation (stretching) of the developing blade can be reduced.

However, in the configuration of Japanese Patent Laid-Open No. 61-185772, since the length of the developing blade in a short direction in the areas near the edge portions are short due to the cutouts in the edge portions of the developing blade, the action of dragging the developer into the nip between the developing blade and the developing roller may become poor.

Accordingly, the triboelectrically charging effect in the nip between the developing blade and the developing roller may decrease, and the possibility of the charge amount of the developer in the edge portions being insufficient compared with the center portion may become further higher. In such a case, the charge amount of the developer in the edge portions is not easily optimized, and it is considered that a deficiency in the edge portion of the image, such as "edge portion fogging", occurs easily.

A configuration of the edge portion seal of the present exemplary embodiment described later is capable or overcoming such a problem as well.

Configuration of Edge Portion Seal

Figure 1:
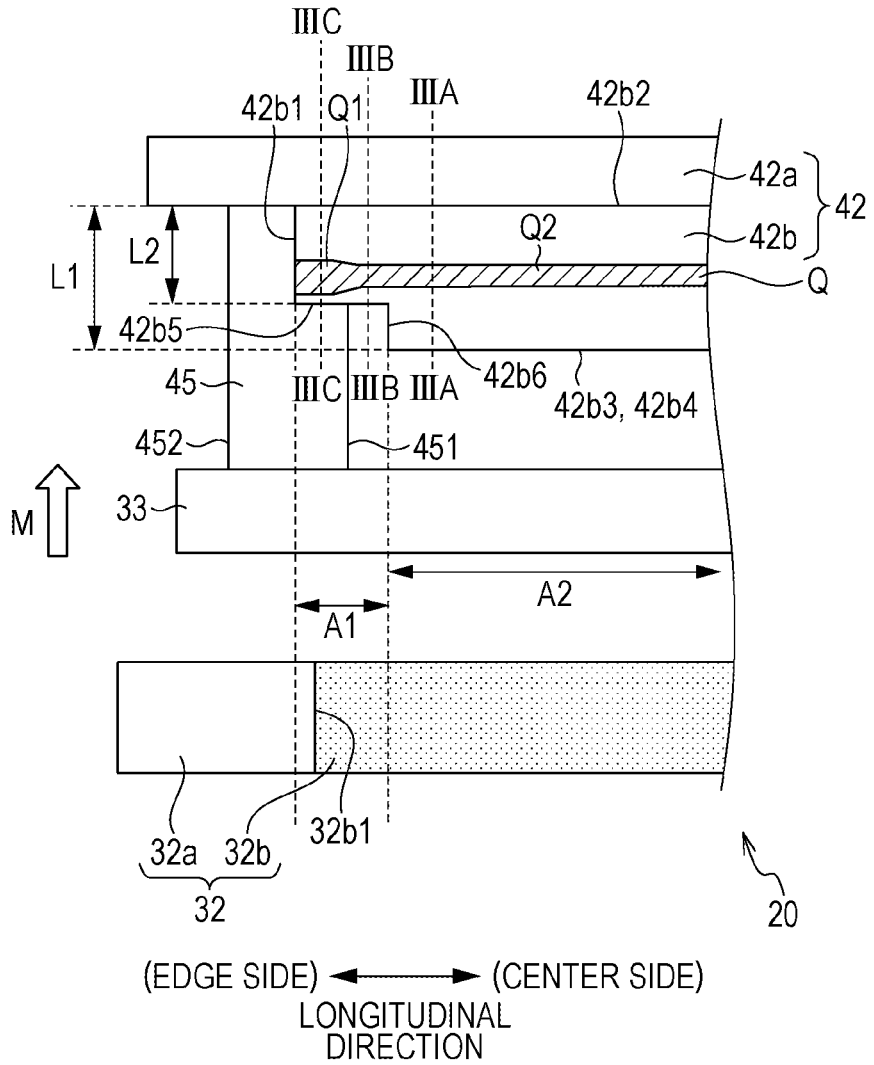
FIG. 1 is a schematic diagram illustrating a configuration of an edge portion of a developing unit of an image forming apparatus according to a first exemplary embodiment of the present disclosure.

Referring hereinafter to FIG. 1, a configuration of the edge portion seal according to the present exemplary embodiment of the present disclosure will be described. Particularly, a positional relationship between the sealing members 45 (the edge portion sealing members), the developing blade 42 (the restricting member), and the carrying layer 32*b* of the developing roller 32 (the developing carrying member) will be described.

FIG. 1 is a schematic diagram illustrating the configuration of the edge portion of the developing unit of the image forming apparatus according to the present exemplary embodiment. Specifically, FIG. 1 illustrates the edge portion of the developing unit 20 (see FIG. 2) in the longitudinal direction (in a rotational axis direction) in a state in which the developing roller 32 is parallelly moved after being dismounted from the developer case 23.

As illustrated in FIG. 1, the developing blade 42 (the restricting member) of the present exemplary embodiment includes a supporting member 42*a*, and an elastic member 42*b* that is attached to the supporting member and that functions as a restricting portion of the developer. The elastic member 42*b* abutting against the carrying layer 32*b* of the developing roller 32 restricts the thickness of the developer carried on the carrying layer 32*b*.

Specifically, in the present exemplary embodiment, the elastic member 42*b* includes a fixed end 42*b*2 that is an end in the short direction (a direction intersecting the longitudinal direction) fixed to the supporting member 42*a*, and a free end 42*b*3 that is an edge portion on the opposite side with respect to the fixed end. The supporting member 42*a* is fixed to the developer case 23.

Note that in the present exemplary embodiment, the fixed end 42*b*2 of the elastic member 42*b* that constitutes the developing blade 42 (the restricting member) is fixed to the developer case 23 with the supporting member 42*a* in between; however, the fixed end 42*b*2 may be directly fixed to the developer case 23 without the supporting member 42*a* in between. In other words, the developing blade 42 may be constituted by the elastic member 42*b* alone.

The sealing members 45 (the edge portion sealing members) are members that prevent the toner T stored in the developer case 23 from moving (leaking out) to the outside from the edge portion of the case in the longitudinal direction of the developing unit 20.

The sealing members 45 are provided between the developer case 23 and the developing roller 32 to prevent the toner inside the developer case 23 (see FIG. 1) from leaking to the outside at the two edge portions of the developing roller 32 in the axial direction (the longitudinal direction). Note that portions of the developing blade 42 are disposed between the developer case 23 (the developing frame) and the developing roller 32 at the edge portions in the longitudinal direction, and the gaps between the developer case 23 and the developing blade 42 are also sealed by the sealing members 45.

More specifically, the sealing members 45 are disposed on sealing member attaching surfaces (not shown) of the developer case 23 so as to abut against the peripheral surfaces of the edge portions of the developing roller 32 in the axial direction. In order to enhance the seal characteristic, portions (edge portions 42*b*1) of the elastic member 42*b* are disposed so as to be interposed between the peripheral surfaces of the edge portions of the developing roller 32 and the sealing members 45.

In other words, as it can be understood from FIG. 1, contact areas between the sealing members 45 and the developing roller 32 (the carrying layer 32*b*), and a contact area between the sealing members 45 and the elastic member 42*b* partially overlap each other in the axial direction (the longitudinal direction) of the developing roller 32.

Furthermore, in the present exemplary embodiment, the elastic member 42*b* of the developing blade 42 abuts against an entire area of the developing roller 32 in the longitudinal direction, and forms a contact portion (nip) Q. Note that in FIG. 1, the contact portion Q is illustrated by oblique lines.

Figure 3A:
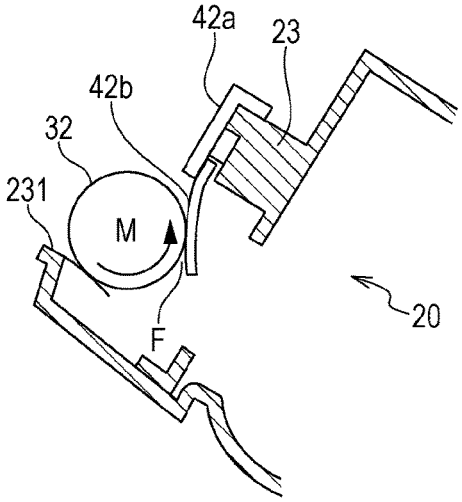
FIGS. 3A to 3C are schematic cross-sectional views of the developing unit of the image forming apparatus according to the first exemplary embodiment of the present disclosure.
Figure 3B:
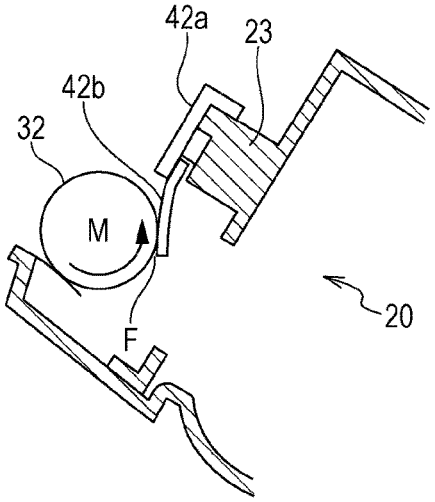
Figure 3C:
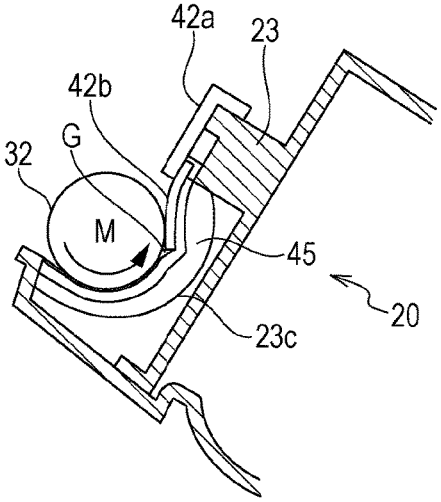

In the present exemplary embodiment, the free end 42*b*3 of the elastic member 42*b* is configured so as to be present on the upstream side in a rotation direction N with respect to the contact portion Q (as shown in FIG. 1 and FIG. 3C) between the elastic member 42*b* and the developing roller 32.

In other words, in the rotation direction N of the developing roller 32, an edge face (42*b*3) of the free end 42*b*3 that is capable of abutting against the carrying layer 32*b* can be disposed on the upstream side with respect to a contact position (the contact portion Q) between the restricting member (the elastic member 42*b*) and the carrying layer (32*b*).

Furthermore, as illustrated in FIG. 1, in the present exemplary embodiment, in the direction (the short direction) intersecting the rotational axis direction (the longitudinal direction) of the developing roller 32, a free end of the elastic member 42*b* in a first area A2 protrudes more towards the upstream side in the rotation direction N compared with a free end in a second area A1.

In other words, in the short direction of the elastic member 42*b* of the developing blade 42, regarding the free lengths between the fixed end 42*b*2 and the free end 42*b*3, a free length L2 of a free end 42*b*5 on the edge portion side in the longitudinal direction is longer than a free length L1 of a free ends 42*b*4 that is inside (on the center side of) the edge portion.

As described above, in the present exemplary embodiment, the elastic member 42*b* constituting the restricting member can include first portions (the second areas A1) positioned on the edge portion sides in the longitudinal direction, and a second portion (the first area A2) positioned inside with respect to the edge portion sides. Note that in an orthogonal direction that is orthogonal to the longitudinal direction, the first portions each can have a first length (L2), and the second portion can have a second length (L1) that is longer than the first length (L2).

Furthermore, the edge portion sealing members (the sealing members 45) can be configured to be in contact with the first portions (the second areas A1) of the restricting member, and to not be in contact with the second portion (the first area A2).

Furthermore, the second portion (the first area A2) of the restricting member can be configured so that the distance to the edge face (42*b*3) of the free end 42*b*3 from the contact position (the contact portion Q) is longer than that of the first portions (the second areas A1).

As described above, in the present exemplary embodiment, the edge portions of the first portions of the elastic member 42*b* constituting the restricting member can be positioned outside the edge portions of the carrying layer 32*b* and inside the outer edge portions of the sealing members 45. With the above, contact portions (Q1) described later can be formed in the first portions.

As illustrated in FIG. 1, in the present exemplary embodiment, the developing roller 32 includes the base 32*a*, and the carrying layer 32*b* formed on the base 32*a*.

More specifically, the developing roller 32 constituting the developer carrying member includes the base 32*a* that, in the orthogonal direction that is orthogonal to the orthogonal to the longitudinal direction, has a round-shaped cross section, and the carrying layer 32*b* is formed on the outer peripheral surface of the base.

Note that in the present exemplary embodiment, the edge portions 32*b*1 of the carrying layer 32*b* in the longitudinal direction are formed so as to be capable of being in contact with the developing blade 42 (the elastic member 42*b*) across the entire area of the outer peripheral surface of the base 32*a* in the circumferential direction during the rotation.

Furthermore, the base 32*a* can be formed with a metal material such as, for example, aluminum or SUS, or with a resin material. Note that the base 32*a* is, desirably, a rigid body. On the other hand, the carrying layer 32*b* can be formed as a cover layer in which a conductive substance, such as carbon black or graphite, or a solid lubricant is dispersed in resin and around which the outer peripheral surface of the base 32*a* is coated. The toner inside the developing apparatus (the developing unit) is provided with an optimum charge amount by being slid and rubbed against the carrying layer 32*b*.

The "carrying portion" of the present disclosure may be formed by laminating the carrying layer 32*b* on the surface of the base 32*a* or may be formed by performing a surface treatment, such as surface roughening, on a portion of the surface of the base 32*a*.

Note that in the present exemplary embodiment, the base 32*a* constituting the developer carrying member is formed in a tubular shape using aluminum. Furthermore, resin including carbon black is sprayed and coated on the surface of the tubular base 32*a* to form the carrying layer 32*b*.

A positional relationship between the carrying layer 32*b* of the present exemplary embodiment, and the sealing members 45 and the developing blade 42 will be described next in a more detailed manner.

As illustrated in FIG. 1, in the present exemplary embodiment, the edge portions 32*b*1 of the carrying layer 32*b* of the developing roller 32 are, in the longitudinal direction, disposed so as to be positioned outside inner edge portions 451 of the sealing members 45 and inside outer edge portions 452 of the sealing members 45.

Furthermore, the edge portions 42*b*1 of the developing blade 42 (the elastic member 42*b*) are disposed so as to be positioned outside the edge portions 32*b*1 of the carrying layer 32*b* and inside the outer edge portions 452 of the sealing members 45.

In other words, in the longitudinal direction, the edge portions 42*b*1 of the developing blade 42 (the elastic member 42*b*) are disposed outside the edge portions 32*b*1 of the carrying layer 32*b*. Furthermore, the outer edge portions 452 of the sealing members 45 are further disposed outside the edge portions 42*b*1 of the developing blade 42 (the elastic member 42*b*).

Furthermore, as it can be understood from FIG. 1, in the present exemplary embodiment, when viewed in the orthogonal direction that is orthogonal to the longitudinal direction, the developing roller 32 and the sealing members 45 are disposed so that portions in the areas of the carrying layer 32*b* of the developing roller 32 and portions in the areas of the sealing members 45 overlap each other in the longitudinal direction.

Moreover, in the longitudinal direction, the edge portions 32*b*1 of the carrying layer 32*b* are positioned inside (on the center portion side of) the edge portions 42*b*1 of the elastic member 42*b* of the developing blade 42.

According to the present exemplary embodiment, the following effects can be obtained by overlapping the elastic member 42*b* and the sealing members 45 at the vicinities of the edge portions in the longitudinal direction.

In other words, the elastic member 42*b* being urged against the developing roller 32 in a further stronger manner tends to have an abutting width Q1 formed with the developing roller 32 at the vicinities of the edge portions in the longitudinal direction be wider than an abutting width Q2 formed with the developing roller 32 at portions other than the edge portions. Accordingly, in the areas where the abutting width Q1 between the developing roller 32 and the elastic member 42*b* has increased, the toner supplied at the vicinities of the edge portions in the longitudinal direction has a higher charge amount by being sufficiently slid and rubbed against the carrying layer 32*b* on the developing roller 32.

As a result, the amount of inverted toner, which is the cause of the "edge portion fogging" at the vicinities of the edge portions in the longitudinal direction, gradually decreases, and an image defect, namely, the "edge portion fogging" decreases.

Furthermore, by having the free end (edge face) 42*b*5 of the elastic member 42*b* be present on the upstream side in the rotation direction M with respect to the contact portions (Q1) formed with the developing roller 32, the abutting width Q1 in the vicinities of the edge portion becomes reliably larger than the abutting width Q2 of the image forming area. With the above, the charge providing effect on the toner at the vicinities of the edge portions in the longitudinal direction is improved. Furthermore, if there is a contact portion between the developing roller 32 and the elastic member 42*b*, the above effect owing to the increase in the abutting width Q1 can be obtained at the vicinities of the portions where the edge portion in the longitudinal direction overlap.

Furthermore, regarding the lengths from the contact portion Q between the elastic member 42*b* and the developing roller 32 to the free end, by having the first area A2 be longer than the second area A1, both the effect of suppressing the "edge portion fogging" and the charge providing effect on the entire area in the longitudinal direction can be improved.

In particular, in the second area A1, by having the free end 42*b*5 of the elastic member 42*b* be present on the upstream side in the rotation direction M with respect to the contact portions (Q1) formed with the developing roller 32, the amount of toner, which is sent to the areas in the vicinities of the edge portions in the longitudinal direction where the abutting width Q1 increases, taken in can be increased appropriately. With the above, the charge amount of the toner at the vicinities of the edge portions in the longitudinal direction can be increased in a further optimum manner.

Referring to FIGS. 3A to 3C and FIGS. 4A to 4D, the effects of the present disclosure will be described in detail.

FIGS. 3A to 3C are schemas (schematic diagrams) illustrating a cross sectional composition of the developing unit 20 of the image forming apparatus according to the present exemplary embodiment.

Specifically, FIG. 3A illustrates a section (in other words, a cross section at the position illustrated by line IIIA-IIIA in FIG. 1) of the developing unit 20 that is orthogonal to the longitudinal direction and that passes the center portion (the first area A2) in the longitudinal direction.

Furthermore, FIG. 3B illustrates a section (in other words, a cross section at the position illustrated by line IIIB-IIIB in FIG. 1) of the developing unit 20 that is orthogonal to the longitudinal direction and that passes the edge portion (the second area A1) in the longitudinal direction.

Furthermore, FIG. 3C illustrates a section (in other words, a cross section at the position illustrated by line IIIC-IIIC in FIG. 1) of the developing unit 20 that is orthogonal to the longitudinal direction and that passes the edge portion (the second area A1) in the longitudinal direction.

As it can be understood from FIG. 1 and FIGS. 3A to 3C, in the elastic member 42*b*, by having the second areas A1 at the two edge portions be shorter than the first area A2 at the center (L2<L1), the following effects can be further obtained.

In other words, in the first area A2 positioned at the center in the longitudinal direction, by taking the toner in a space F (illustrated in FIG. 3A) formed between the developing roller 32 and the elastic member 42*b*, the toner coat layer on the developing roller 32 can be restricted to have a predetermined layer thickness.

Meanwhile, in the second areas A1 positioned at the edge portions in the longitudinal direction, a space G (illustrated in FIG. 3C) created by the elastic member 42*b* and the sealing members 45 overlapping each other can be smaller than the space F. In other words, in the second area A1, the space G can be decreased down to the thickness of the elastic member 42*b*.

Since the space formed between the developing roller 32 and the elastic member 42*b* is smaller in the second area A1 compared with that in the first area A2, the amount of toner taken in is smaller in the space G (illustrated in FIG. 3C) positioned on the edge portion side than in the space F (illustrated in FIG. 3A) positioned on the center side. Accordingly, compared with the first area A2, the amount of toner that is moved in the longitudinal direction by being pushed by the toner taken in subsequently is smaller in the second area A1, and the leaking of the toner from the edge portions of the developer case is reduced further.

Note that in the longitudinal direction, since the charge amount of the toner on the carrying layer 32*b* of the developing roller 32 is optimized by sliding and rubbing with the carrying layer 32*b* and the elastic member 42*b*, retention of the toner on the carrying layer 32*b* is facilitated with image force created by the electric charge of the toner.

As described above, in the present exemplary embodiment, since the carrying layer 32*b* is disposed on the inner side (the center) in the longitudinal direction with respect to the elastic member 42*b*, the toner is rarely conveyed to the outside of the edge portions of the elastic member 42*b* in the longitudinal direction, and the sealing of the toner with the edge portion sealing members can be reliably performed.

Referring next to FIGS. 4A to 4D, comparative examples of the present exemplary embodiment will be described.

FIGS. 4A to 4D are schematic diagrams of the configuration of an edge portion of reference examples (the comparative examples) to describe the effects of the present exemplary embodiment.

Figure 4A:
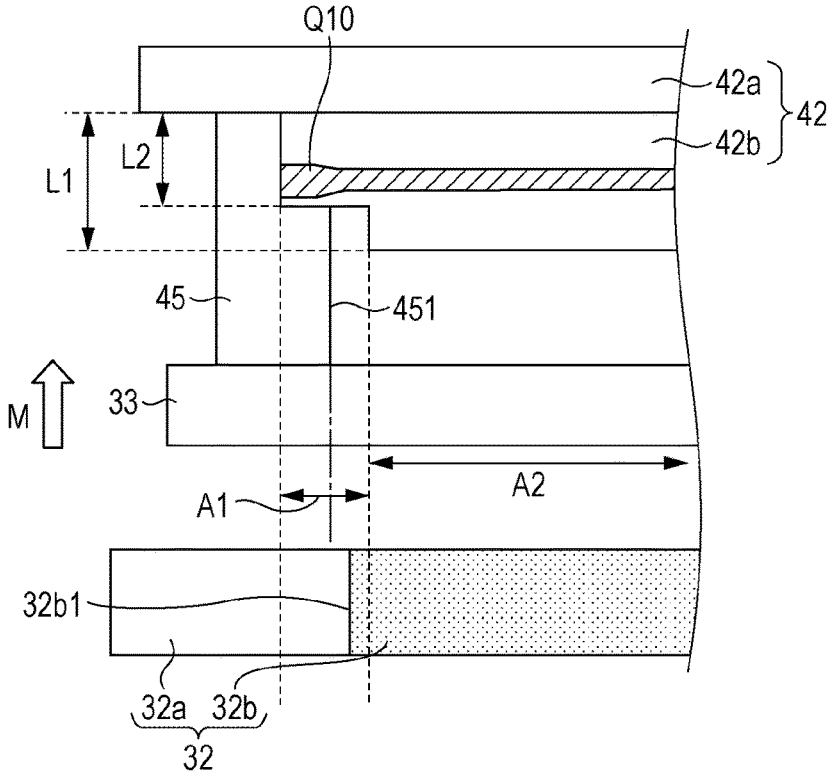
FIGS. 4A to 4D are schematic diagrams illustrating configurations of edge portions of reference examples for describing effects of the first exemplary embodiment of the present disclosure.

As illustrated in FIG. 4A, in a case in which the edge portion positions (32*b*1) of the carrying layer 32*b* in the longitudinal direction are inside (on the center side of) the edge portion positions (451) of the sealing member 45, there will be areas in which an abutting width Q10 is increased. In such an area, since there is no sliding nor rubbing against the carrying layer 32*b*, an optimum charge amount of the toner at the vicinities of the edge portions in the longitudinal direction is not easily obtained. Accordingly, when compared with the present exemplary embodiment described above, the improvement effect of the "edge portion fogging" in the configuration of the comparative example illustrated in FIG. 4A is small.

Figure 4B:
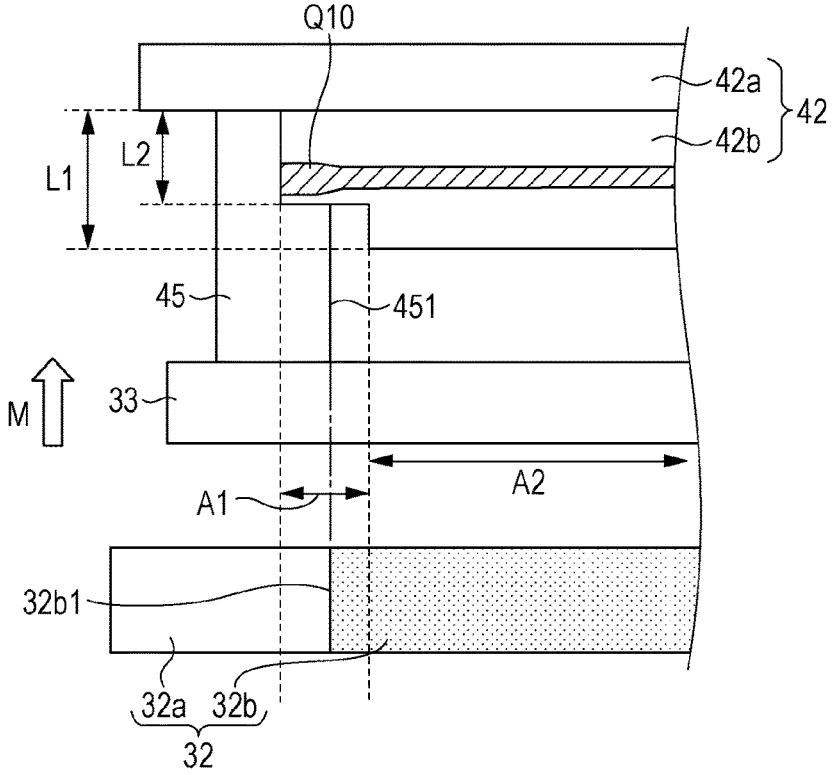

Furthermore, as illustrated in FIG. 4B, in a case in which the edge portion positions (32*b*1) of the carrying layer 32*b* in the longitudinal direction are the same as the edge portion positions (451) of the sealing members 45, the toner coating amount at the boundaries of the carrying layer 32*b* increases. Accordingly, triboelectricity providing (triboelectrically charging) effect is decreased in the areas where the abutting width Q10 increases. As a result, when compared with the present exemplary embodiment described above, the suppressing effect of the "edge portion fogging" in the configuration of the comparative example illustrated in FIG. 4B is small.

Figure 4C:
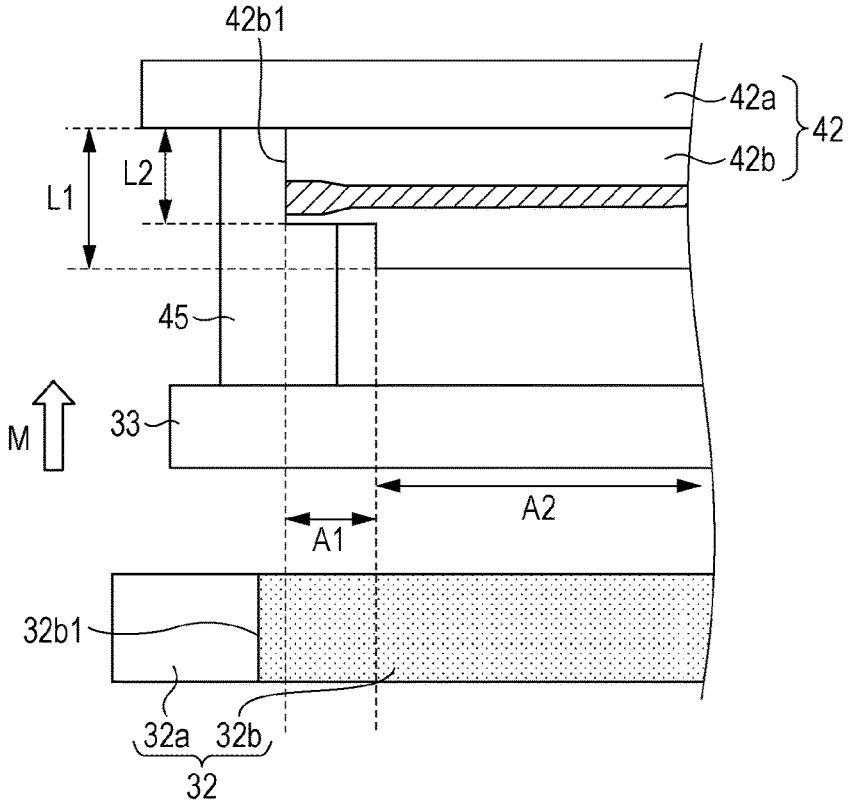
Figure 4D:
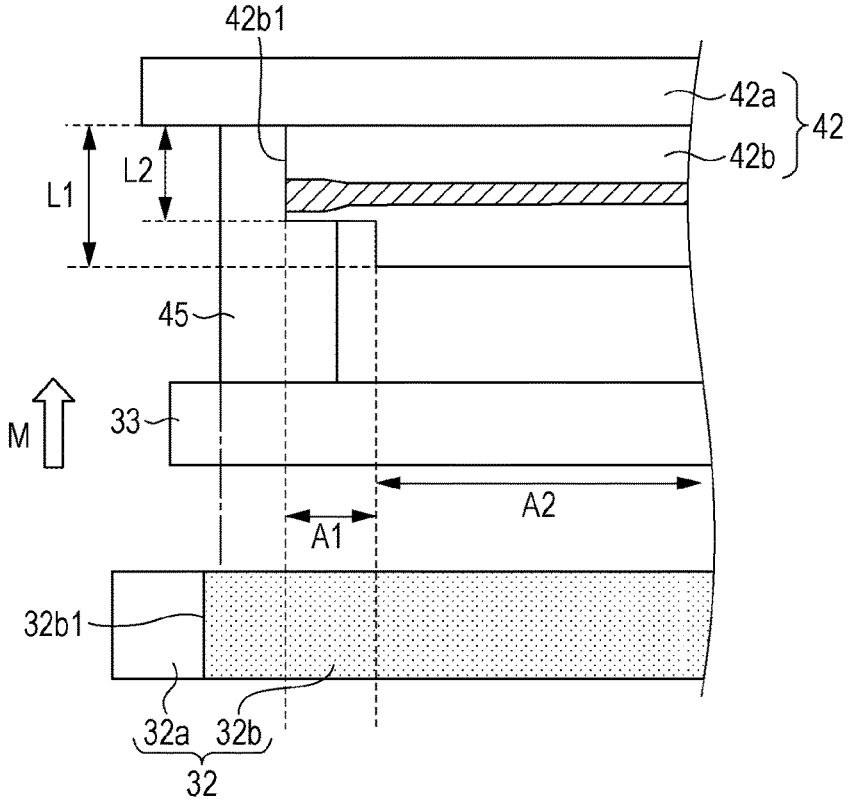

Furthermore, as illustrated in FIGS. 4C and 4D, in a case in which the edge portion positions (32*b*1) of the carrying layer 32*b* in the longitudinal direction are on the outer side with respect to the edge portions (42*b*1) of the elastic member 42*b*, the toner is easily conveyed to the outside of the edge portions 42*b*1 of the elastic member 42*b*. Accordingly, when compared with the present exemplary embodiment described above, in the configurations of the comparative examples illustrated in FIGS. 4C and 4D, the sealing of the toner becomes more difficult and the toner leaks to the outside from the sealing members 45 more easily.

Note that as described above, in order to obtain the effects of the present disclosure, basically, the carrying layer 32*b* and the sealing members 45 need to be disposed so as to overlap each other in the longitudinal direction as illustrated in FIG. 1. Note that regarding the overlapping portion, it is available to provide the carrying layer 32*b* on at least a portion (a partial area) of the tubular base 32*a* in the circumferential direction. However, in order to further optimize the charge amount of the toner at the edge portions in the longitudinal direction, desirably, the carrying layer 32*b* is provided not only in the partial area but in the entire area of the tubular base 32*a* in the circumferential direction.

Furthermore, the developing blade 42 may be formed of a rigid material, such as metal, since it is easier to obtain the charge amount improving effect due to an increase in the pressure against the developing roller 32 at the edge portions. Note that an elastic material is more desirable as the material constituting the developing blade 42 since the easily deforming characteristics thereof can facilitate the effect of increasing the "abutting width Q1".

As described above, in the present exemplary embodiment, the edge portions 32*b*1 of the carrying layer 32*b* can be disposed on the outer side with respect to the inner edge portions 451 of the sealing members 45, and the edge portions 32*b*1 of the carrying layer 32*b* can be disposed on the inner side with respect to the edge portions 42*b*1 of the elastic member 42*b*. With the above, as well as improving the triboelectrically charged characteristics of the toner in the edge portion areas, leakage of the toner through the edge portions of the developer case can be suppressed effectively. In other words, the toner conveyed along the carrying layer 32*b* from the center side in the longitudinal direction towards the edge portion sides can be supplied to the contact portions (Q1) more easily, and the triboelectric charge characteristics of the edge portions improve. Meanwhile, since the toner that has been conveyed from the center side in the longitudinal direction towards the edge portion sides rarely goes over the edge portions 42*b*1 of the elastic member 42*b*, the toner rarely goes over the sealing members 45 such that leakage to the outside becomes more rare.

Furthermore, in the present exemplary embodiment, the free end 42*b*5 of the elastic member 42*b* can be disposed so as to protrude on the upstream side in the rotation direction M with respect to the contact portions (Q1). With the above, the take in amount of the toner in the contact portions (Q1) can be appropriately increased, and the charge amount of the toner at the vicinities of the edge portions in the longitudinal direction can be increased in a further optimum manner.

As described above, in the configuration of the present exemplary embodiment, both suppression in the "edge portion fogging" and increase in the seal characteristic can be achieved. In other words, as well as effectively suppressing the edge portion leakage of the developer stored in the frame, the occurrence of a defect in the image edge portion can be decreased.

Second Exemplary Embodiment

A second exemplary embodiment of the present disclosure basically has a configuration that is similar to that of the first exemplary embodiment, and the points that are different will be described with reference to FIGS. 5 and 6.

Figure 5:
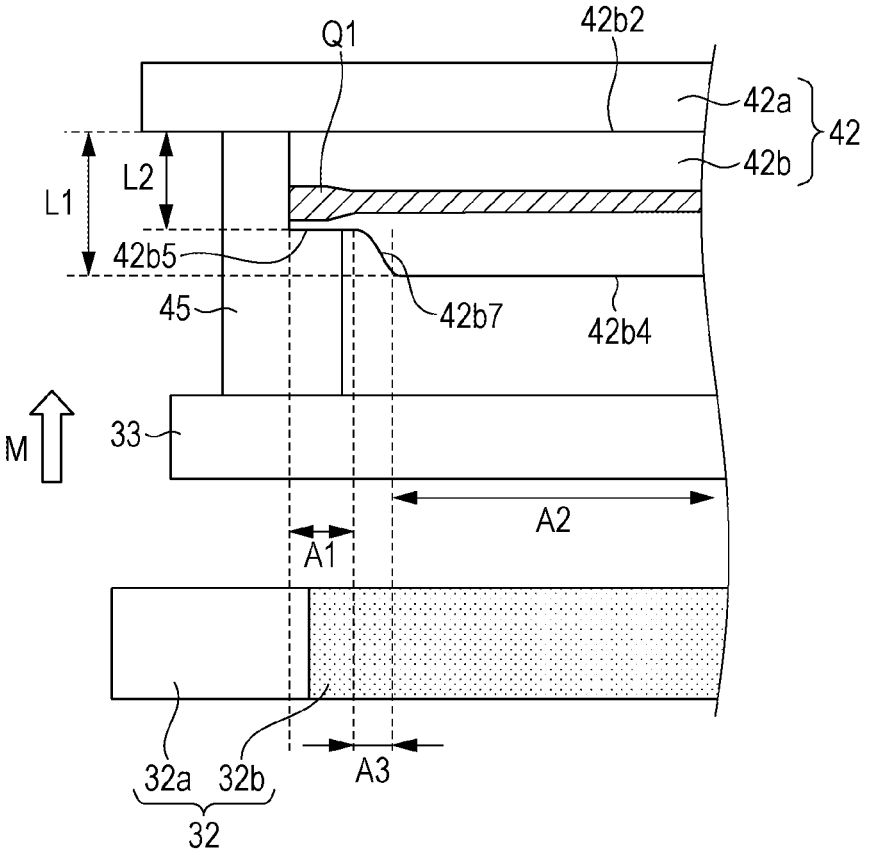
FIG. 5 is a schematic diagram illustrating a configuration of an edge portion of a developing unit of an image forming apparatus according to a second exemplary embodiment of the present disclosure.

FIG. 5 is a schematic diagram illustrating a configuration of the edge portion of the developing unit of the image forming apparatus of the present exemplary embodiment. Furthermore, FIG. 6 is a perspective view schematically illustrating a configuration of the developing unit of the present exemplary embodiment.

As illustrated in FIG. 5, mainly, the elastic member 42*b* of the present exemplary embodiment is different from that of the first exemplary embodiment.

Specifically, as illustrated in FIG. 1, in the first exemplary embodiment, the elastic member 42*b* includes two areas (in other words, the first area A2 and the second area A1) that have different lengths from the fixed end 42*b*2 to the free ends 42*b*4 or 42*b*5. Note that a step portion 42*b*6 orthogonal to the longitudinal direction is provided between the free ends 42*b*4 and the free end 42*b*5.

Figure 6:
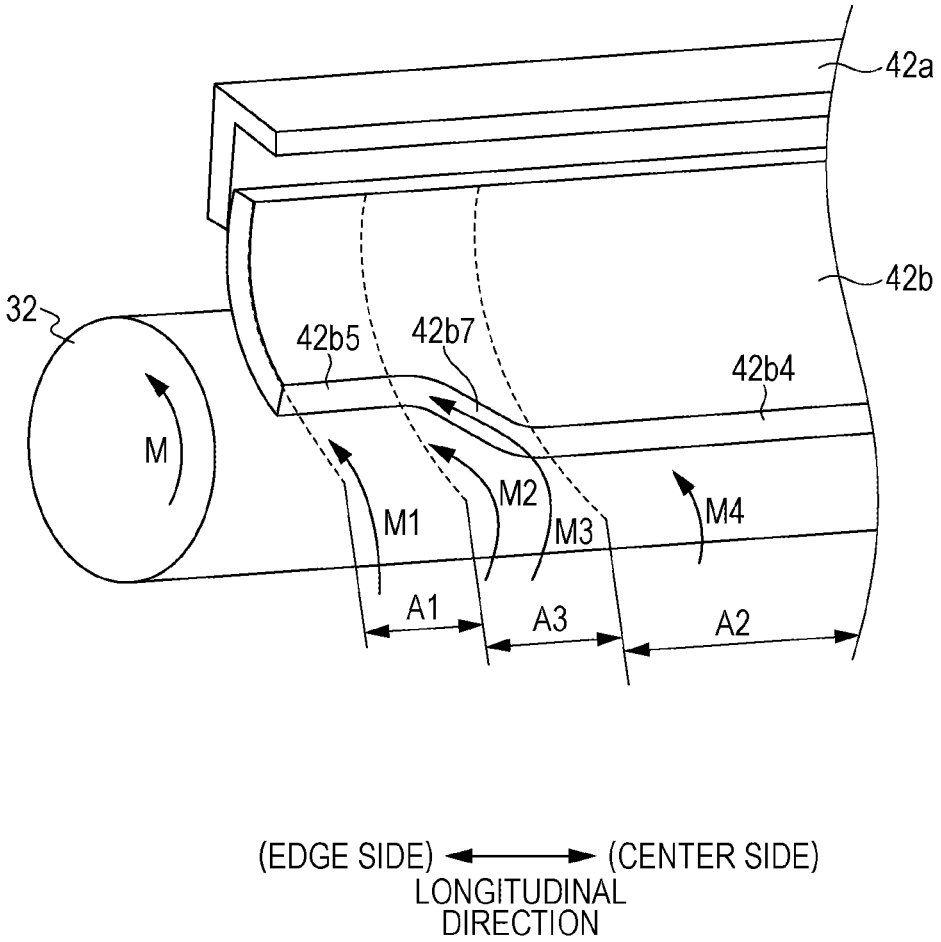
FIG. 6 is a perspective view schematically illustrating the developing unit of the image forming apparatus according to the second exemplary embodiment of the present exemplary embodiment.

Conversely, as illustrated in FIGS. 5 and 6, in the elastic member 42*b* of the present exemplary embodiment, an area at a center portion (hereinafter, referred to as a first area A2) and areas at edge portions (hereinafter, referred to as second areas A1) are connected to each other with inclined areas (hereinafter, referred to as third areas A3).

Specifically, in the present exemplary embodiment, the second area A1 includes the free end 42*b*5 that is gently inclined in the longitudinal direction with respect to the third areas A3 or that has a shape that is not inclined (parallel).

In other words, the third areas A3 present between the first area A2 and the second areas A1 of the elastic member 42*b* are each formed across the corresponding second area A1 and the first area A2 so that the distant between the fixed end 42*b*2 to a corresponding free end 42*b*7 gradually increases. In other words, the free ends 42*b*7 of the third areas A3 are formed so as to be inclined with respect to the free end 42*b*5 in the first area A2 and the free ends 42*b*4 in the second areas A1.

In other words, in the longitudinal direction, the elastic member 42*b* constituting the restricting member can include third portions (the third areas A3) that are disposed between the first portions (the second areas A1) and the second portion (the first area A2), and that connect the first portions and the second portion to each other.

Furthermore, the third portions (the third areas A3) may be configured so as to be longer than the first length L2 and that is shorter than the second length L1.

Furthermore, the length of the third portions (the third areas A3) may continuously change from the first length L2 to the second length L1.

Furthermore, as it can be understood from FIG. 5, the sealing members 45 may be in contact with the first portions (the second areas A1) of the restricting member (the elastic member 42*b*), and not be in contact with the third portions (the third areas A3).

As illustrated in FIG. 6, in the present exemplary embodiment, by rotation of the developing roller 32 in the rotation direction M, as indicated by arrow directions M1 to M4, the toner, without being retained, moves (circulates) towards the outer side in the longitudinal direction along the inclined shape of the free end 42*b*7 positioned in the third area A3. As a result, sending of the toner to the portions where the abutting width Q1 (see FIG. 5) between the elastic member 42*b* and the developing roller 32 increases is facilitated further. With the above, the charge applying effect increases and the "edge portion fogging" phenomenon can be reduced further.

Furthermore, as illustrated in FIG. 5, in the present exemplary embodiment, the second area A1 that has an inclination in the longitudinal direction that is gentle with respect to the inclination of the free ends 42*b*7 of the third areas A3 or that has no inclination can be positioned on the edge portion side in the longitudinal direction with respect to the third area A3.

Furthermore, the movement of the toner occurring in the second areas A1 is caused by the rotation of the developing roller 32. Accordingly, in the present exemplary embodiment, driving force in the second area A1 towards the outer side in the longitudinal direction is smaller and the conveying speed of the toner in the second area A1 is attenuated. As a result, leaking of the toner, which moves in the longitudinal direction through the space G (see FIG. 3C), from the edge portions of the developer case rarely occurs.

As described above, by using the image forming apparatus of the present exemplary embodiment, the "edge portion fogging" can be suppressed even more while increasing the edge portion sealing characteristics of the developer case.

Others

The developing unit (the developing apparatus) described above may be configured as a developing cartridge by forming the developing unit (the developing apparatus) into a cartridge that is detachable from the apparatus main body of the image forming apparatus that forms an image.

Note that the image forming apparatus of the present exemplary embodiment may include the image carrying member on which an electrostatic latent image is formed, and a developing unit that develops the electrostatic latent image formed on the image carrying member.

Furthermore, in the present exemplary embodiment, while the cartridge B is detachable from the apparatus main body A, the apparatus main body A and the cartridge B may be integrated to form the image forming apparatus.

Furthermore, the image forming apparatus of the present exemplary embodiment may form an image using a process cartridge that is detachable from the apparatus main body of the image forming apparatus.

The developing apparatus, the cartridge, and the image forming apparatus can, as well as effectively suppressing the edge portion leakage of the developer stored in the frame, decrease the occurrence of a defect in the image edge portion.

While the present invention has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-069286 filed Mar. 30, 2017 and No. 2018-033618 filed Feb. 27, 2018, which are hereby incorporated by reference herein in their entirety.

What is claimed is:

1. A developing apparatus comprising:

a developer carrying member that includes a carrying portion that carries developer;

a developing frame that stores the developer carried by the developer carrying member, the developing frame rotatably supporting the developer carrying member at an edge portion of the developer carrying member in a longitudinal direction;

a restricting member disposed in the longitudinal direction, the restricting member restricting a thickness of the developer carried on the carrying portion, wherein the restricting member includes a supporting member, and an elastic member attached to the supporting member, and wherein the elastic member restricts the thickness of the developer carried on the carrying portion by abutting against the carrying portion; and an edge portion sealing member disposed between the edge portion of the developer carrying member and an edge portion of the developing frame that supports the edge portion of the developer carrying member, the edge portion sealing member restricting leakage of the developer in the edge portion of the developing frame, wherein in the longitudinal direction, an edge portion of the carrying portion is disposed so as to be positioned outside an inner edge portion of the edge portion sealing member, and inside an outer edge portion of the edge portion sealing member, and wherein an edge portion of the restricting member is disposed so as to be positioned outside the edge portion of the carrying portion, and inside the outer edge portion of the edge portion sealing member.

2. The developing apparatus according to claim 1, wherein the restricting member includes a fixed end fixed to the developing frame, and a free end capable of abutting against the carrying portion, and wherein in a rotation direction of the developer carrying member, an edge face of the free end is disposed upstream of a contact position in which the restricting member and the carrying portion abut against each other.

3. The developing apparatus according to claim 2, wherein the restricting member includes a first portion that has a first length in an orthogonal direction that is orthogonal to the longitudinal direction, the first portion being positioned on an edge portion side in the longitudinal direction, and a second portion that has a second length in the orthogonal direction longer than the first length, the second portion being positioned inside with respect to the edge portion side in the longitudinal direction, and wherein the edge portion sealing member is in contact with the first portion of the restricting member, and is not in contact with the second portion.

4. A developing apparatus comprising:

a developer carrying member that includes a carrying portion that carries developer;

a developing frame that stores the developer carried by the developer carrying member, the developing frame rotatably supporting the developer carrying member at an edge portion of the developer carrying member in a longitudinal direction; a restricting member disposed in the longitudinal direction, the restricting member restricting a thickness of the developer carried on the carrying portion, and an edge portion sealing member disposed between the edge portion of the developer carrying member and an edge portion of the developing frame that supports the edge portion of the developer carrying member, the edge portion sealing member restricting leakage of the developer in the edge portion of the developing frame, wherein in the longitudinal direction, an edge portion of the carrying portion is disposed so as to be positioned outside an inner edge portion of the edge portion sealing member, and inside an outer edge portion of the edge portion sealing member, wherein an edge portion of the restricting member is disposed so as to be positioned outside the edge portion of the carrying portion, and inside the outer edge portion of the edge portion sealing member, wherein the restricting member includes a fixed end fixed to the developing frame, and a free end capable of abutting against the carrying portion, wherein in a rotation direction of the developer carrying member, an edge face of the free end is disposed upstream of a contact position in which the restricting member and the carrying portion abut against each other, wherein the restricting member includes a first portion that has a first length in an orthogonal direction that is orthogonal to the longitudinal direction, the first portion being positioned on an edge portion side in the longitudinal direction, and a second portion that has a second length in the orthogonal direction longer than the first length, the second portion being positioned inside with respect to the edge portion side in the longitudinal direction, wherein the edge portion sealing member is in contact with the first portion of the restricting member, and is not in contact with the second portion, and wherein in the longitudinal direction, an edge portion corresponding to the first portion of the restricting member is disposed so as to be positioned outside of the edge portion of the carrying portion and inside the outer edge portion of the edge portion sealing member.

5. The developing apparatus according to claim 3, wherein in the rotation direction of the developer carrying member, the edge face of the free end corresponding to the first portion of the restricting member is disposed upstream of the contact position.

6. The developing apparatus according to claim 3, wherein the second portion has a length from the contact position to the edge face of the free end that is longer in distance than that of the first portion.

7. The developing apparatus according to claim 3, wherein the restricting member includes a third portion disposed between the first portion and the second portion in the longitudinal direction, the third portion connecting the first portion and the second portion to each other.

8. The developing apparatus according to claim 7, wherein in the orthogonal direction, the third portion is larger than the first length, and is smaller than the second length.

9. The developing apparatus according to claim 7, wherein the third portion has a length that continuously changes from the first length to the second length.

10. The developing apparatus according to claim 7, wherein the edge portion sealing member is in contact with the first portion of the restricting member and is not in contact with the third portion.

11. The developing apparatus according to claim 1, wherein the developer carrying member includes a cylindrical base, and wherein the carrying portion is provided on an outer peripheral surface of the base, and is formed of a carrying layer capable of carrying the developer.

12. The developing apparatus according to claim 11, wherein the edge portion of the carrying portion in the longitudinal direction is formed across an entire area of the outer peripheral surface of the base in a circumferential direction, and wherein the edge portion of the carrying portion is capable of coming in contact with the restricting member when the developer carrying member rotates.

13. A developing apparatus comprising:

a developer carrying member that includes a carrying portion that carries developer;

a developing frame that stores the developer carried by the developer carrying member, the developing frame rotatably supporting the developer carrying member at an edge portion of the developer carrying member in a longitudinal direction;

a restricting member disposed in the longitudinal direction, the restricting member restricting a thickness of the developer carried on the carrying portion, and an edge portion sealing member disposed between the edge portion of the developer carrying member and an edge portion of the developing frame that supports the edge portion of the developer carrying member, the edge portion sealing member restricting leakage of the developer in the edge portion of the developing frame, wherein in the longitudinal direction, an edge portion of the carrying portion is disposed so as to be positioned outside an inner edge portion of the edge portion sealing member, and inside an outer edge portion of the edge portion sealing member, wherein an edge portion of the restricting member is disposed so as to be positioned outside the edge portion of the carrying portion, and inside the outer edge portion of the edge portion sealing member, wherein the developer carrying member includes a cylindrical base, wherein the carrying portion is provided on an outer peripheral surface of the base, and is formed of a carrying layer capable of carrying the developer, and wherein the developer carrying member includes a magnet roller inserted in the base.

14. The developing apparatus according to claim 11, wherein the carrying layer charges the developer by sliding and rubbing against the developer.

15. The developing apparatus according to claim 11, wherein the carrying layer is a cover layer that coats the outer peripheral surface of the base.

16. The developing apparatus according to claim 15, wherein the base is a rigid body, and wherein the cover layer is formed of a resin material that is a resin dispersed with a conductive substance.

17. The developing apparatus according to claim 1, wherein the developing apparatus is detachable from an apparatus main body of an image forming apparatus that forms an image.

18. A cartridge comprising:

an image carrying member on which an electrostatic latent image is formed; and a developing apparatus that develops the electrostatic latent image formed on the image carrying member including, a developer carrying member that includes a carrying portion that carries developer, a developing frame that stores the developer carried by the developer carrying member, the developing frame rotatably supporting the developer carrying member at an edge portion of the developer carrying member in a longitudinal direction, a restricting member disposed in the longitudinal direction, the restricting member restricting a thickness of the developer carried on the carrying portion, wherein the restricting member includes a supporting member, and an elastic member attached to the supporting member, and wherein the elastic member restricts the thickness of the developer carried on the carrying portion by abutting against the carrying portion; and an edge portion sealing member disposed between the edge portion of the developer carrying member and an edge portion of the developing frame that supports the edge portion of the developer carrying member, the edge portion sealing member restricting leakage of the developer in the edge portion of the developing frame, wherein in the longitudinal direction, an edge portion of the carrying portion is disposed so as to be positioned outside an inner edge portion of the edge portion sealing member, and inside an outer edge portion of the edge portion sealing member, and wherein an edge portion of the restricting member is disposed so as to be positioned outside the edge portion of the carrying portion, and inside the outer edge portion of the edge portion sealing member.

19. An image forming apparatus comprising:

an image carrying member on which an electrostatic latent image is formed; and a developing apparatus that develops the electrostatic latent image formed on the image carrying member including, a developer carrying member that includes a carrying portion that carries developer, a developing frame that stores the developer carried by the developer carrying member, the developing frame rotatably supporting the developer carrying member at an edge portion of the developer carrying member in a longitudinal direction, a restricting member disposed in the longitudinal direction, the restricting member restricting a thickness of the developer carried on the carrying portion, wherein the restricting member includes a supporting member, and an elastic member attached to the supporting member, and wherein the elastic member restricts the thickness of the developer carried on the carrying portion by abutting against the carrying portion; and an edge portion sealing member disposed between the edge portion of the developer carrying member and an edge portion of the developing frame that supports the edge portion of the developer carrying member, the edge portion sealing member restricting leakage of the developer in the edge portion of the developing frame, wherein in the longitudinal direction, an edge portion of the carrying portion is disposed so as to be positioned outside an inner edge portion of the edge portion sealing member, and inside an outer edge portion of the edge portion sealing member, and wherein an edge portion of the restricting member is disposed so as to be positioned outside the edge portion of the carrying portion, and inside the outer edge portion of the edge portion sealing member.

20. The developing apparatus according to claim 4, wherein in the rotation direction of the developer carrying member, the edge face of the free end corresponding to the first portion of the restricting member is disposed upstream of the contact position.

21. The developing apparatus according to claim 4, wherein the second portion has a length from the contact position to the edge face of the free end that is longer in distance than that of the first portion.

22. The developing apparatus according to claim 4, wherein the restricting member includes a supporting member, and an elastic member attached to the supporting member, and wherein the elastic member restricts the thickness of the developer carried on the carrying portion by abutting against the carrying portion.

23. The developing apparatus according to claim 4, wherein the restricting member includes a third portion disposed between the first portion and the second portion in the longitudinal direction, the third portion connecting the first portion and the second portion to each other.

24. The developing apparatus according to claim 23, wherein in the orthogonal direction, the third portion is larger than the first length, and is smaller than the second length.

25. The developing apparatus according to claim 23, wherein the third portion has a length that continuously changes from the first length to the second length.

26. The developing apparatus according to claim 23, wherein the edge portion sealing member is in contact with the first portion of the restricting member and is not in contact with the third portion.

27. The developing apparatus according to claim 4, wherein the developer carrying member includes a cylindrical base, and wherein the carrying portion is provided on an outer peripheral surface of the base, and is formed of a carrying layer capable of carrying the developer.

28. The developing apparatus according to claim 27, wherein the edge portion of the carrying portion in the longitudinal direction is formed across an entire area of the outer peripheral surface of the base in a circumferential direction, and wherein the edge portion of the carrying portion is capable of coming in contact with the restricting member when the developer carrying member rotates.

29. The developing apparatus according to claim 26, wherein the carrying layer charges the developer by sliding and rubbing against the developer.

30. The developing apparatus according to claim 26, wherein the carrying layer is a cover layer that coats the outer peripheral surface of the base.

31. The developing apparatus according to claim 30, wherein the base is a rigid body, and wherein the cover layer is formed of a resin material that is a resin dispersed with a conductive substance.

32. The developing apparatus according to claim 4, wherein the developing apparatus is detachable from an apparatus main body of an image forming apparatus that forms an image.

33. The developing apparatus according to claim 13, wherein in the rotation direction of the developer carrying member, the edge face of the free end corresponding to the first portion of the restricting member is disposed upstream of the contact position.

34. The developing apparatus according to claim 13, wherein the second portion has a length from the contact position to the edge face of the free end that is longer in distance than that of the first portion.

35. The developing apparatus according to claim 13, wherein the restricting member includes a supporting member, and an elastic member attached to the supporting member, and wherein the elastic member restricts the thickness of the developer carried on the carrying portion by abutting against the carrying portion.

36. The developing apparatus according to claim 13, wherein the restricting member includes a third portion disposed between the first portion and the second portion in the longitudinal direction, the third portion connecting the first portion and the second portion to each other.

37. The developing apparatus according to claim 36, wherein in the orthogonal direction, the third portion is larger than the first length, and is smaller than the second length.

38. The developing apparatus according to claim 36, wherein the third portion has a length that continuously changes from the first length to the second length.

39. The developing apparatus according to claim 36, wherein the edge portion sealing member is in contact with the first portion of the restricting member and is not in contact with the third portion.

40. The developing apparatus according to claim 13,
wherein the developer carrying member includes a cylindrical base, and
wherein the carrying portion is provided on an outer peripheral surface of the base, and is formed of a carrying layer capable of carrying the developer.

41. The developing apparatus according to claim 40,
wherein the edge portion of the carrying portion in the longitudinal direction is formed across an entire area of the outer peripheral surface of the base in a circumferential direction, and
wherein the edge portion of the carrying portion is capable of coming in contact with the restricting member when the developer carrying member rotates.

42. The developing apparatus according to claim 39,
wherein the carrying layer charges the developer by sliding and rubbing against the developer.

43. The developing apparatus according to claim 39,
wherein the carrying layer is a cover layer that coats the outer peripheral surface of the base.

44. The developing apparatus according to claim 43,
wherein the base is a rigid body, and
wherein the cover layer is formed of a resin material that is a resin dispersed with a conductive substance.

45. The developing apparatus according to claim 13,
wherein the developing apparatus is detachable from an apparatus main body of an image forming apparatus that forms an image.

* * * * *